US006070266A

United States Patent [19]

Terashita et al.

[11] Patent Number: 6,070,266

[45] Date of Patent: Jun. 6, 2000

[54] BASEBALL OR SOFTBALL GLOVE

[75] Inventors: Masaki Terashita, Osaka; Ken Motooka, Hyogo, both of Japan

[73] Assignee: Mizuno Corporation, Osaka, Japan

[21] Appl. No.: 09/321,627

[22] Filed: May 28, 1999

[30] Foreign Application Priority Data

Oct. 27, 1998 [JP] Japan ..... 10-322835

[51] Int. Cl.[7] ..... A41D 13/08

[52] U.S. Cl. ..... 2/19; 2/161.1; 473/458

[58] Field of Search ..... 2/19, 159, 161.1; 473/458

[56] References Cited

U.S. PATENT DOCUMENTS

| | | | |
|---|---|---|---|
| 1,631,735 | 6/1927 | Kennedy et al. . | |
| 1,826,851 | 10/1931 | Whitley . | |
| 2,031,808 | 2/1936 | Whitley . | |
| 2,113,934 | 4/1938 | Denkert . | |
| 2,200,204 | 5/1940 | Le Mat . | |
| 2,284,920 | 6/1942 | Nolte et al. . | |
| 2,288,467 | 6/1942 | Latina . | |
| 2,510,246 | 6/1950 | Oliver et al. . | |
| 2,629,096 | 2/1953 | Latina . | |
| 2,725,561 | 12/1955 | Blepp . | |
| 2,750,594 | 6/1956 | Denkert . | |
| 2,988,744 | 6/1961 | Stobbe . | |
| 2,995,756 | 8/1961 | Latina . | |
| 3,098,234 | 7/1963 | Latina . | |
| 4,227,263 | 10/1980 | Zidele . | |
| 4,720,875 | 1/1988 | Latina et al. . | |
| 5,448,775 | 9/1995 | Yamada et al. | 2/19 |
| 5,659,897 | 8/1997 | Satoh et al. | 2/19 |
| 5,694,641 | 12/1997 | Doi et al. | 2/19 |

*Primary Examiner*—Diana Oleksa
*Assistant Examiner*—Katherine Moran
*Attorney, Agent, or Firm*—McDermott, Will & Emery

[57] ABSTRACT

A tip end portion of a baseball or softball glove is laced using a web lacing to lace a web attached between the thumb finger stall and the first finger stall, and a fingertip lacing to lace the part from the first finger stall to the little finger stall. A pair of top and bottom front portion side and back portion side apertures are provided close to each adjacent finger stall at the tip of the front and back portions from the first finger stall to the little finger stall. A fingertip lacing is sequentially horizontally passed through the upper ones of these apertures, and then sequentially horizontally through the lower apertures to lace the part from the first finger stall to the little finger stall.

7 Claims, 10 Drawing Sheets

BASEBALL OR SOFTBALL GLOVE

BACKGROUND OF THE INVENTION

1. Field of the Invention

The present invention relates generally to baseball or softball gloves (hereinafter simply as gloves), and more particularly, to an improved construction of lacing which permits the spacings between the individual finger stalls for the first finger to little finger to be easily adjusted.

2. Description of the Background Art

A conventional glove has tips laced using a single long lacing 1' as shown in FIGS. 10 and 11. Lacing 1' is wound around the edge of the web from the tip of the thumb stall (section) and passed through pairs of upper and lower apertures 20 and 21 at the tips of the front and back sides 2 and 3, respectively from a first finger stall 5*b* to a little finger stall 5*e*. The aperture pairs are each provided close to an adjacent finger stall.

Lacing 1' is typically passed through first finger stall 5*b* to little finger 5*e* crisscross on the front side.

U.S. Pat. No. 3,098,234 discloses the construction of a glove in which a single lacing is passed through the tips of the first finger stall to the little finger stall transversely from the front side to the back side and both ends of the lacing are interconnected at the tip end of the little finger stall. U.S. Pat. No. 4,720,875 discloses the construction of a glove in which an upper lacing is passed through transversely on the back side from the little finger stall, first finger stall, web and to the tip end of the thumb finger stall and folded at the thumb finger stall, and both ends of the lacing are interconnected on the back side at the little finger stall, with two lower lacings similarly passed under the upper lacing and interconnected.

In the conventional gloves shown in FIGS. 10 and 11, a single long lacing is passed from the tip of the thumb stall, wound around the edge of the web and then passed criss-cross on the front side from the first finger stall tip to the little finger stall tip. Therefore, it takes much trouble to widen the spacings between the finger stalls or tighten the lacings overstretched with time. When a lacing is cut at the tip end portion of the web, the lacing 1' which could be as long as 150 cm or longer from the thumb stall to the little finger stall must be passed again, which is trouble some.

If a single lacing is simply passed transversely through the tip end portion of the finger stalls as disclosed by U.S. Pat. No. 3,098,234, sufficient strength is not provided or durability is low, so that the tip end portions of the stalls tend to spread and stable catch cannot be achieved. If the upper and lower lacings are passed transversely through the tip ends of finger stalls from the little finger stall, the first finger stall, the web to the thumb stall on the back side of the glove as disclosed by U.S. Pat. No. 4,720,875, each lacing must be laced when the spacing between each finger stall is adjusted, so that the adjustment of the spacings between the finger stalls of the glove is not easy.

SUMMARY OF THE INVENTION

The present invention is directed to a solution to the above-described problems. It is one object of the present invention to provide a glove having high durability which permits the spacings between the finger stalls of the glove to be easily adjusted, the lacings at the finger tips to be easily attached, and the shape of the glove to be subtly adjusted.

The baseball or softball glove includes front and back portions stitched together. The glove according to the present invention includes a thumb stall, a first finger stall, a middle finger stall, a third finger stall, a little finger stall, a web between the thumb stall and the first finger stall, a web lacing to tie the web to the thumb stall and the first finger stall and fingertip lacing to lace the part from the first finger stall to the little finger stall. The fingertip lacing includes a first line portion passed through the front portion and extending from the first finger stall to the little finger stall, a second line portion passed through the front portion and extending substantially parallel to the first line portion, a third line portion passed through the back portion and extending from the first finger stall to the little finger stall, and a fourth line portion passed through the back portion and extending substantially parallel to the third line portion.

The first, second, third and fourth line portions may be formed by a single lacing.

The first and second line portions may be formed by a first lacing and the third and fourth line portions may be formed by a second lacing. In this case, the knot of both ends of the first lacing may be located at the back of the first finger stall, and the knot of both ends of the second lacing may be located at the back of the little finger stall. The knot of both ends of the first lacing may be located at the back of the little finger stall, and the knot of both ends of the second lacing may be located at the back of the first finger stall.

If the above glove has a padding material inside, at least one of the first to fourth line portions is preferably passed through the padding material.

Preferably, at the front portion from the first finger stall to the little finger stall, a pair of front side apertures are provided in the direction in which the finger stalls extend, while at the back portion from the first finger stall to the little finger stall, a pair of back side apertures are provided in the direction in which the finger stalls extend. In this case, the first and second line portions are passed through the front side apertures, while the third and fourth line portions are passed through the back side apertures.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A glove according to the present invention includes a front leather portion (ball receiving face) and a back leather portion (back side face) of natural leather, artificial leather, or other material of similar quality, stitched together having a padding inside, and essential parts of an outer leather portion are laced with leather lacings. While the tip end portions of conventional gloves are laced using a single long fingertip lacing the part from the thumb stall to the little finger stall, in the glove according to the present invention, the lacing is divided into a web lacing portion which laces the web attached between the thumb stall and the first finger stall and a fingertip lacing portion which laces the tip end portions from the first finger stall to the little finger stall.

The web lacing is passed through apertures in the back portion at the tip end of the thumb stall, wound spirally around the edge of the web, and then passed through apertures in the front and back portions at the tip of the first finger stall. Then, the tip of the lacing is passed through the lacing of the web spirally wound around the edge of the web and through the web tip and drawn from the tip end of the thumb stall at the back portion of the glove. Both ends of the web lacing drawn from the first and final apertures are interconnected.

Pairs of upper and lower apertures are provided on the front portion side each close to an adjacent finger stall from the first finger stall to the little finger stall. A fingertip lacing is sequentially horizontally passed through the upper apertures on the front portion side, and then similarly sequentially horizontally through the lower apertures. Pairs of upper and lower apertures are provided on the back portion side from the first finger stall to the little finger stall each close to an adjacent finger stall. A fingertip lacing is sequentially horizontally passed through the upper apertures on the back portion side and then similarly sequentially horizontally thorugh the lower apertures. The lacings lace the part from the first finger stall to the little finger of the glove.

Embodiments of the present invention will be now described in conjunction with the accompanying drawings.

Figure 1:
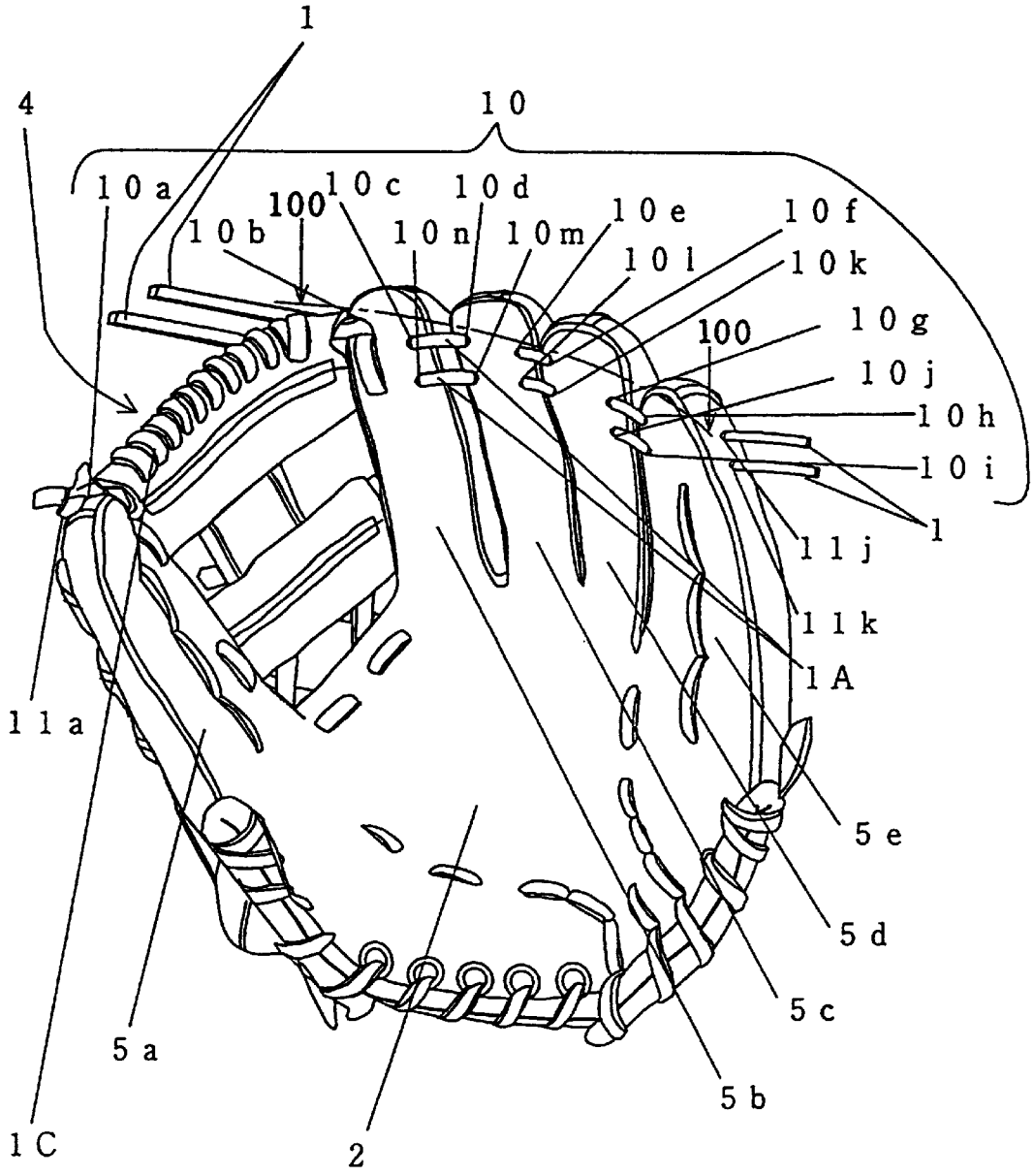
FIG. 1 is a front view of a glove having two fingertip lacings i.e., front and back side fingertip lacings.
Figure 2:
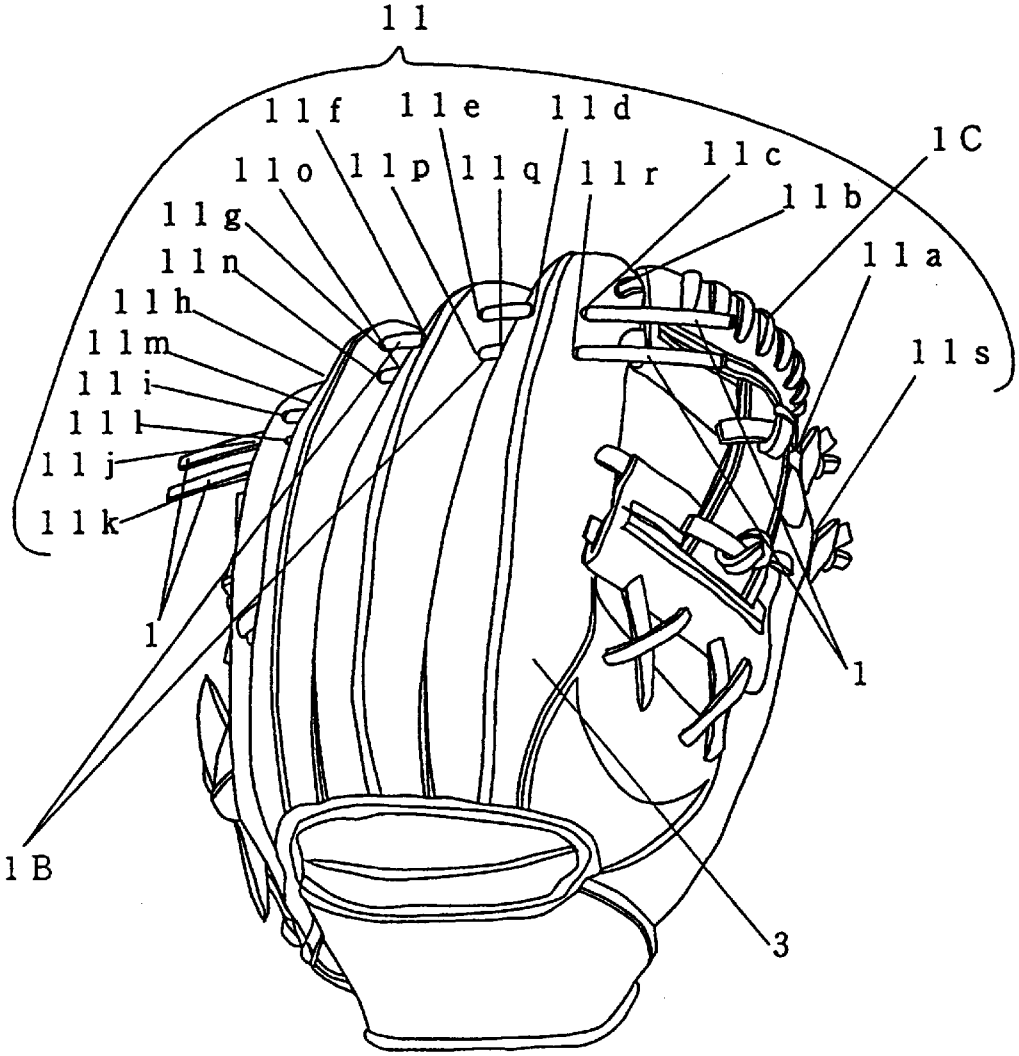
FIG. 2 is a rear view of FIG. 1.
Figure 3:
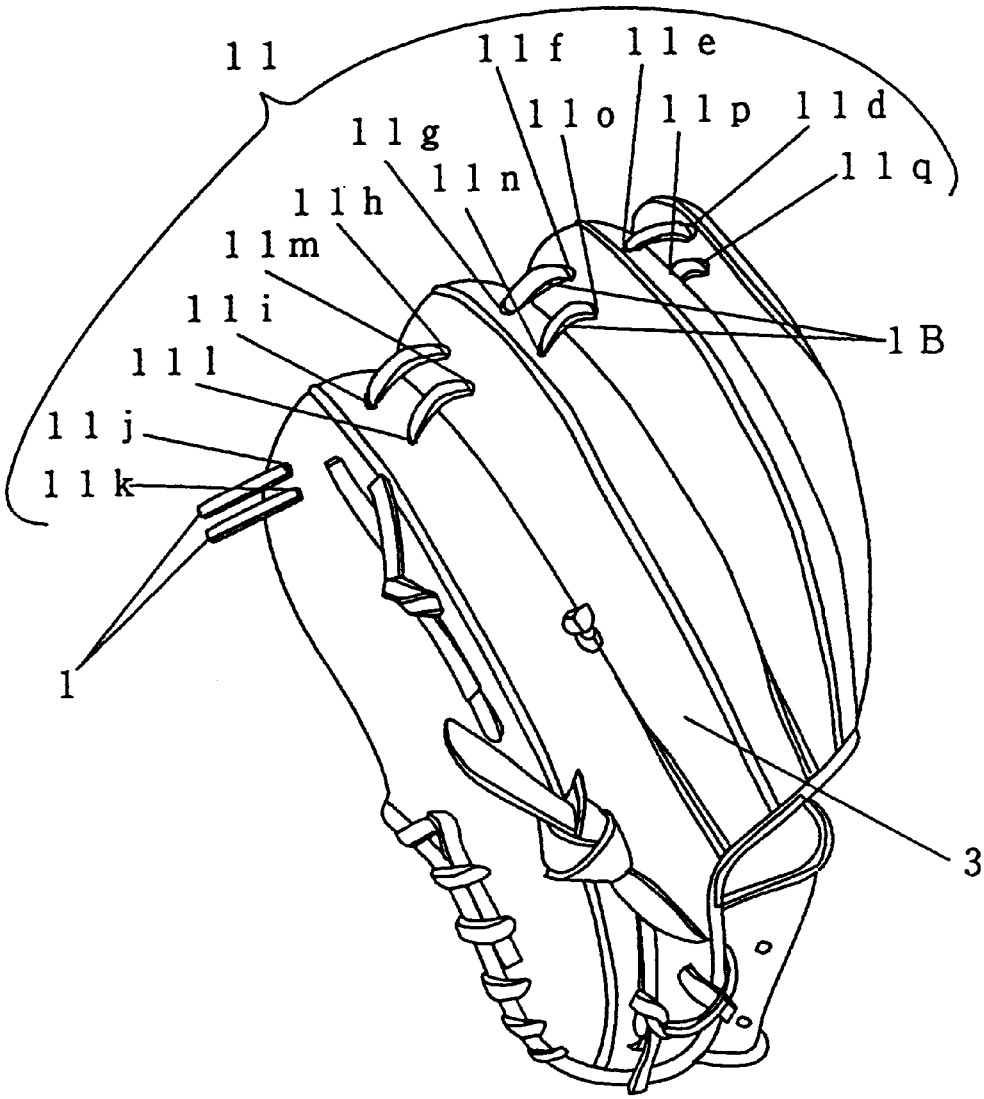
FIG. 3 is a side view of the little finger side of FIG. 1.
Figure 4:
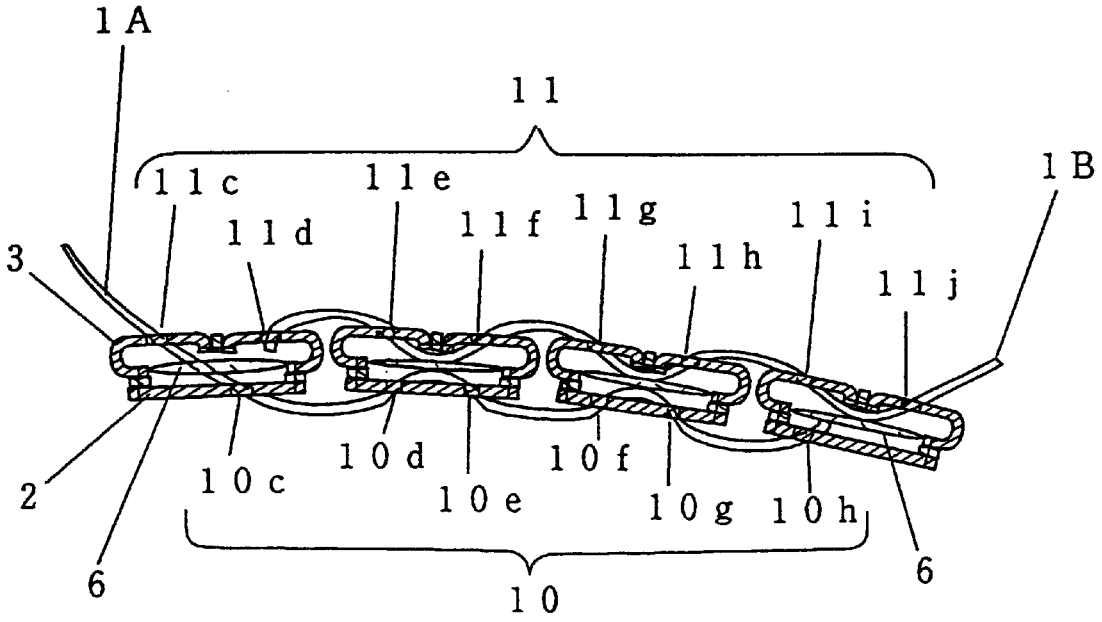
FIG. 4 is a cross sectional view taken along 100—100 in FIG. 1 showing the case in which a fingertip lacing on the front side is passed through a padding in the first finger stall.

FIGS. 1 to 3 are a front view of an embodiment having two lacings, i.e., a front side fingertip lacing 1A and a back side fingertip lacing 1B instead of fingertip lacing 1, a rear view thereof and a side view of the little finger side, respectively.

A web lacing C is passed from a back side aperture 11*a* at the tip of the thumb stall to an aperture 10*a* on the opposite, front portion side, wound spirally around the edge 4 of the web from the end of the thumb stall side to the end of the first finger stall side, then through an aperture 10*b* on the front side at the tip of the first finger stall to an aperture 11*b* on the opposite, rear portion side, through web lacing 1C wound around the web edge 4 and web edge 4, then through aperture 11*a* through which the lacing is first passed, and drawn from a back side aperture 11*s* under back side aperture 11*a*. The ends of web lacing 1C drawn from the first and final back side apertures 11*a* and 11*s* are each knotted.

In this embodiment, front side fingertip lacing 1A and back side fingertip lacing 1B are passed differently depending upon whether front side fingertip lacing 1A is passed through the padding 6 of fist finger stall 5*b* or through the padding 6 of little finger stall 5*e*.

Lacing through the padding 6 of first finger stall 5*b* will be now described. As shown in FIGS. 1 to 4, front side fingertip lacing 1A is passed from back side aperture 11*c* at the tip of the first finger stall, then through the padding 6 of first finger stall 5*b*, then drawn from front side aperture 10*c* at the tip end of the first finger stall, then passed through back side aperture 10*d* of the tip of middle finger stall, drawn from front side aperture 10*e* at the finger tip, then passed through the front side aperture 10*f* of the third finger stall tip, drawn from front side aperture 10*g* at the finger stall tip, passed through front side aperture 10*h* of the little finger stall and then drawn from front side aperture 10*i* under this front side aperture 10*h*.

In the opposite direction in which the lacing has been passed through apertures 10*c*, 10*d*, 10*e*, 10*f* and 10*g* on the front portion side at respective tips of finger stalls, front side fingertip lacing 1A is sequentially passed through front side lower apertures 10*j*, 10*k*, 10*l*, 10*m* and 10*n* at respective tips of finger stalls, then passed through the padding 6 of first finger stall 5*b*, and drawn from an aperture 11*r* on the back portion side at the tip of the first finger stall. The end of the lacing drawn from aperture 11*r* and the end drawn from back side aperture 11*c* at the tip of the first finger stall, the aperture through which the lacing has been passed first, are interconnected.

Fingertip lacing 1B on the back portion side described above is passed from a back side aperture 11*j* at the tip of the little finger stall, drawn from a back side aperture 11*i* at the same finger stall, then passed through a back side aperture 11*h* at the tip of the third finger stall, drawn from a back side aperture 11*g* at the tip of the same finger stall, then passed through a back side aperture 11*f* at the tip of the middle finger stall, drawn from a back side aperture 11*e* at the tip of the same finger, then passed through a back side aperture 11*d* at the tip of the first finger stall, and drawn from a back side aperture 11*q* under back side aperture 11*d*.

Subsequently, in the opposite direction to the direction in which the lacing has been passed through apertures 11*j*, 11*i*, 11*h*, 11*g*, 11*f* and 11*e*, fingertip lacing 1B on the back portion side is sequentially passed through back side lower apertures 11*p*, 11*o*, 11*n*, 11*m*, 11*l* and 11*k* at the tips of respective finger stalls, and drawn from an aperture 11*k* on the back portion side at the tip of the little finger stall. The end of the lacing drawn from aperture 11*k* and the end drawn from an back side aperture 11*j* at the tip of the little finger stall through which the lacing has been passed first are interconnected.

When fingertip lacing 1A on the front portion side is passed through the padding 6 of little finger stall 5*e*, front side fingertip lacing 1A and back side fingertip lacing 1B are passed in the opposite order to the case in which they are passed through the padding 6 of first finger stall 5*b*.

As described above, when there are two lacings such as front side fingertip lacing 1A and back side fingertip lacing 1B, the spacings between finger stalls from first finger stall 5*b* to little finger stall 5*e* can be easily widen simply by pulling finger stall tips apart. Meanwhile, the spacings between the finger stalls from first finger stall 5*b* to little finger stall 5*e* may be easily narrowed by holding and pulling apart both ends of lacings 1A and 1B.

When lacings 1A and 1B constitute a single, leather lacing, the lacing is passed differently depending upon whether or not the lacing is passed through the padding 6 of first finger stall 5*b* through little finger 5*e*.

Figure 5:
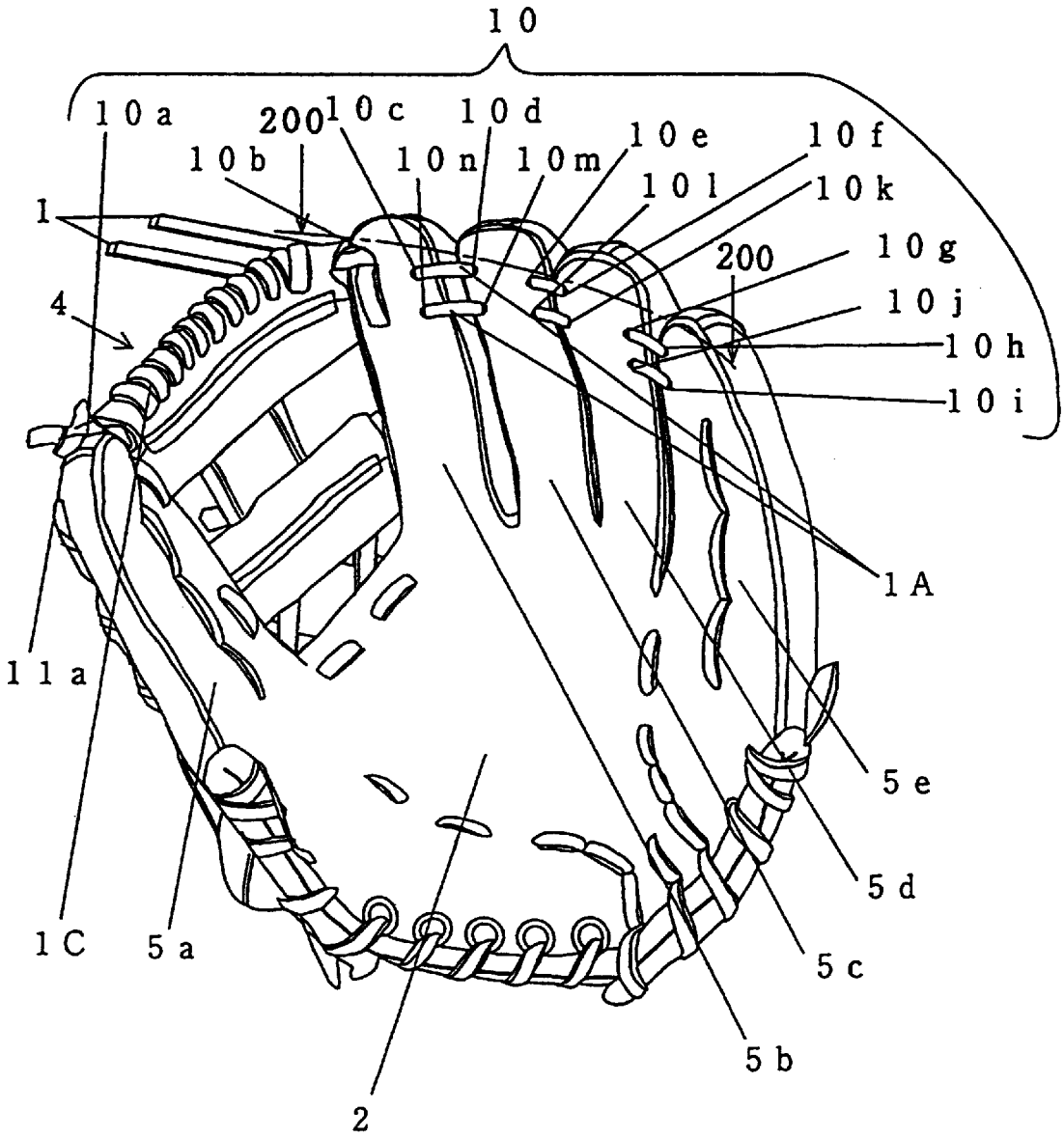
FIG. 5 is a front view of a glove having a single, leather fingertip lacing which is tied on the back portion side at the tip of the fist finger stall.
Figure 6:
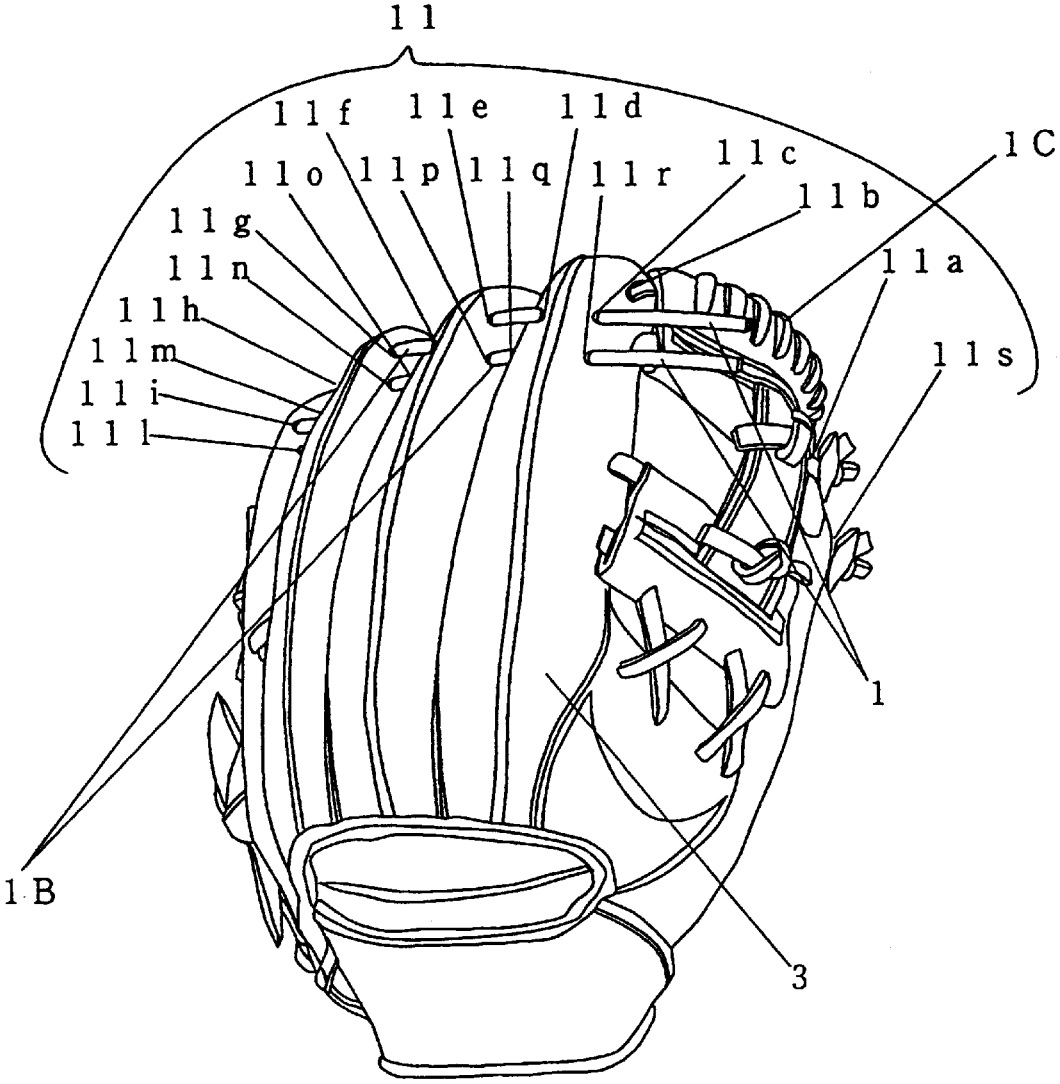
FIG. 6 is a rear view of FIG. 5.
Figure 7:
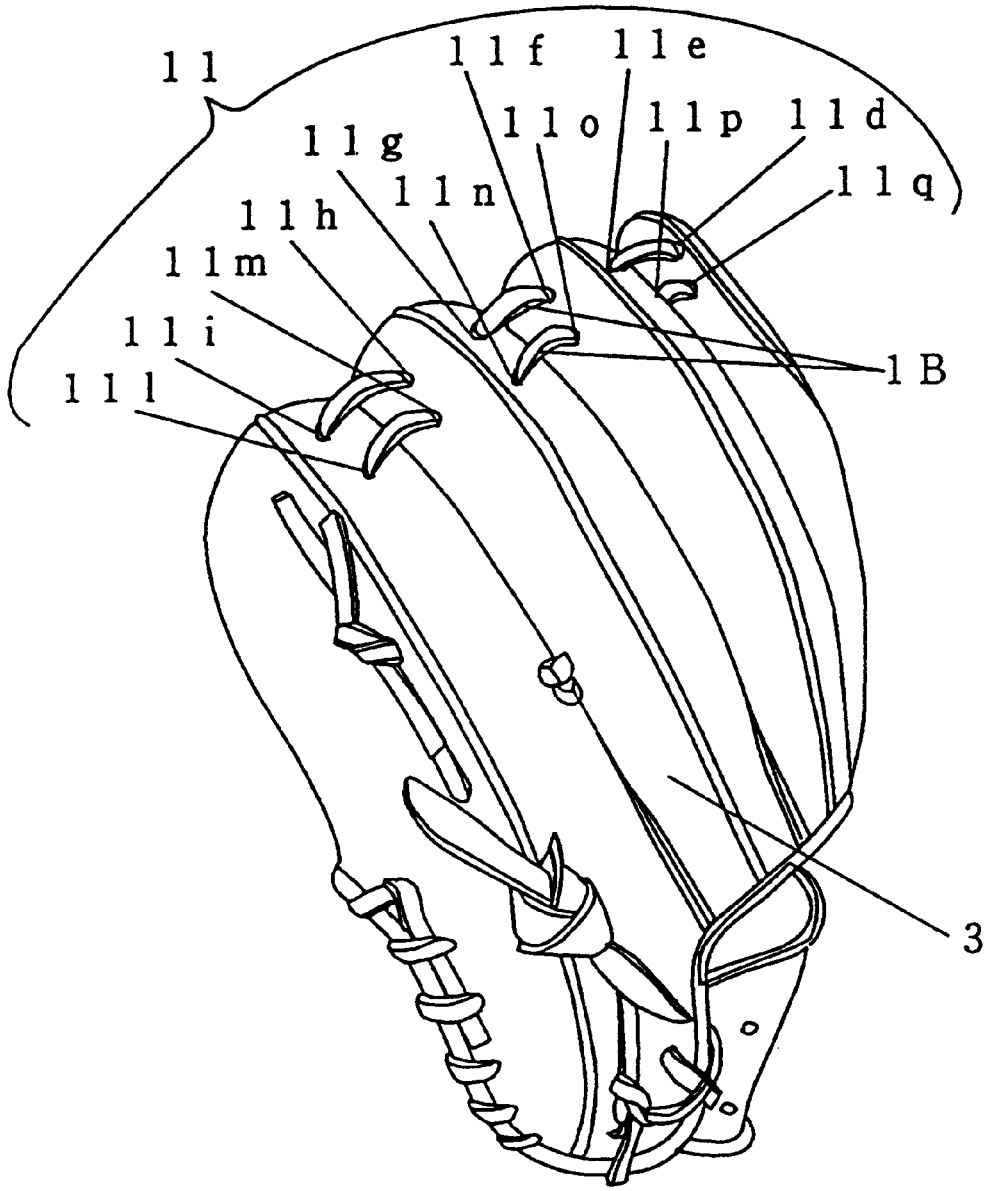
FIG. 7 is a side view of the little finger side of FIG. 5.
Figure 8:
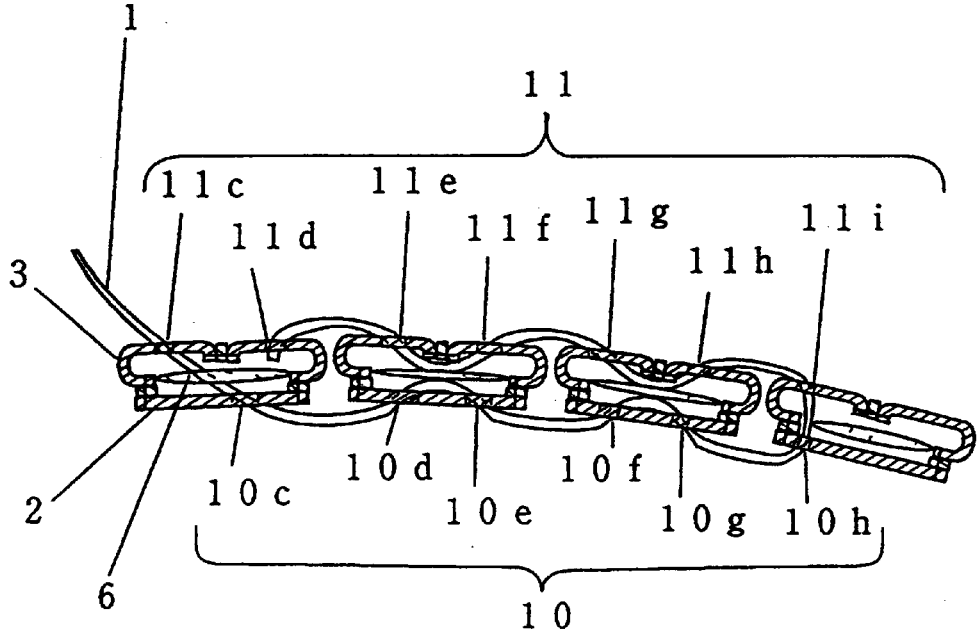
FIG. 8 is a cross sectional view taken along line 200—200 in FIG. 5 showing a glove in which a fingertip lacing is passed through a padding and tied on the back side of the first finger stall.
Figure 9:
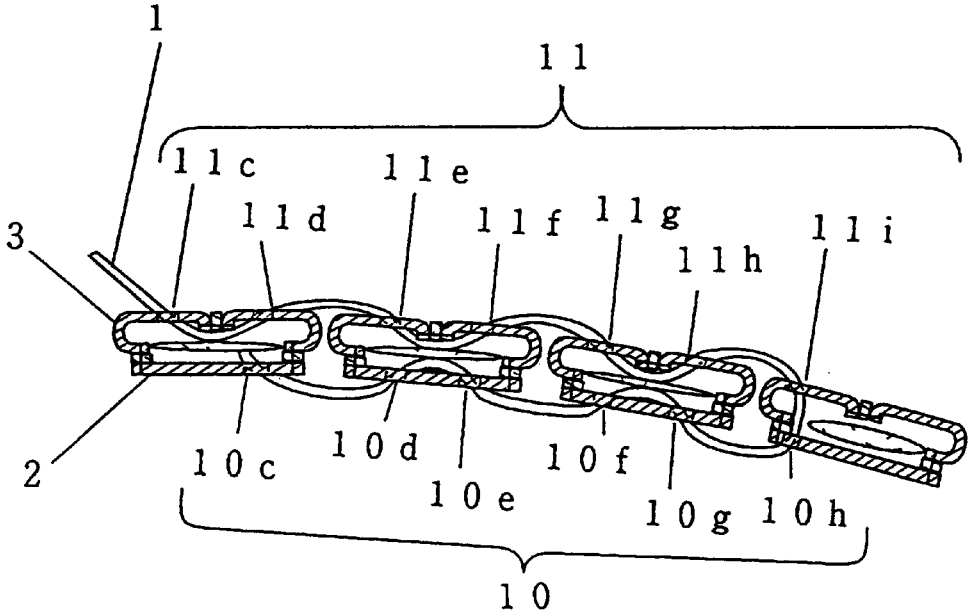
FIG. 9 is a cross sectional view taken along line 200—200 in FIG. 5 showing a glove in which a fingertip lacing is tied on the back side of the first finger stall without being passed through a padding.
Figure 10:
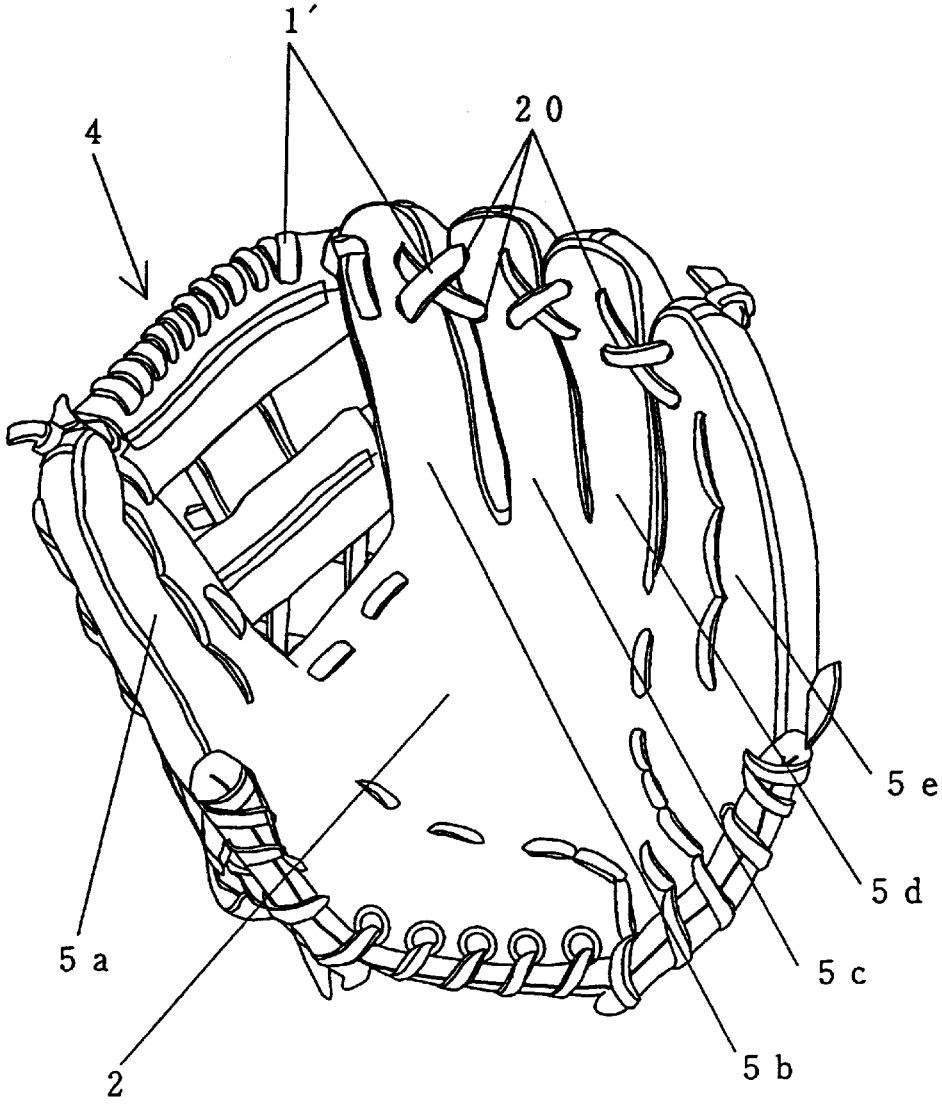
FIG. 10 PRIOR ART
FIG. 10 is a front view of a conventional glove.
Figure 11:
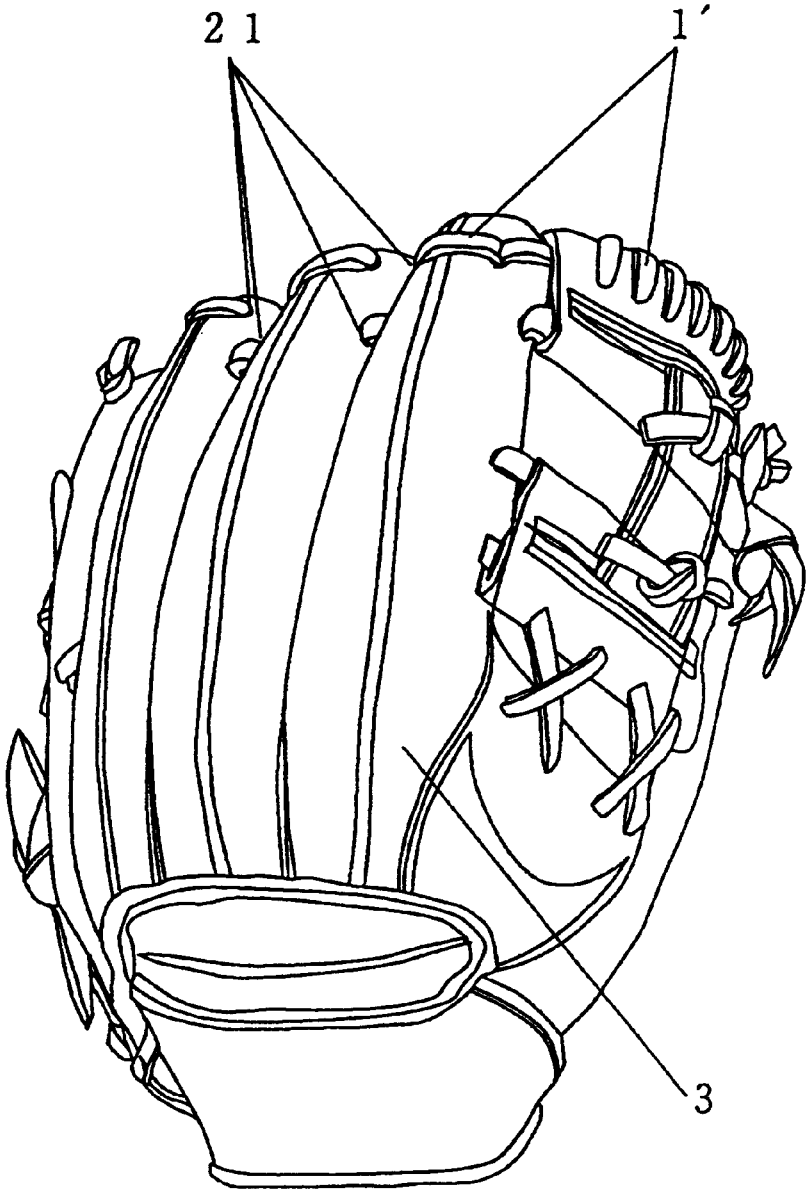
FIG. 11 PRIOR ART
FIG. 11 is a rear view of FIG. 10.

FIGS. 5 to 7 are a front view of an embodiment in which fingertip lacing 1 is a single leather lacing, and both ends are interconnected at the back portion of the first finger stall, a rear view thereof and a side view of the little finger stall.

Web lacing 1C is passed through the tip end portion of the glove and tied similarly to the case in which two lacings, front side fingertip lacing 1A and back side fingertip lacing 1B are provided instead of the single lacing 1.

The case in which fingertip lacing 1 is passed through the padding 6 of first finger stall 5*b* will be now described. As shown in FIGS. 5 to 8, fingertip lacing 1 is passed through aperture 11*c* on the back portion side at the tip end of the first finger stall, then passed through the padding 6 of first finger 5*b*, drawn from front side aperture 10*c* at the tip end of the first finger stall, then sequentially passed through front side apertures 10*d*, 10*e*, 10*f* and 10*g* at middle finger stall 5*c* and third finger stall 5*d*, then passed through front side aperture 10*h* at the tip end of the little finger stall, and then drawn from aperture 11*i* on the opposite, back portion side. Subsequently, fingertip lacing 1 is sequentially passed through back side apertures 11*h*, 11*g*, 11*f* and 11*e* at third finger stall 5*d* and middle finger 5*c*, then passed through back side aperture 11*d* at the tip end of the first finger stall, and drawn from back side aperture 11*q* under aperture 11*d*.

Then, in the opposite direction to the direction in which the lacing has been passed through apertures 11*i*, 11*h*, 11*g*, 11*f* and 11*e*, fingertip lacing 1 is sequentially passed through back side lower apertures 11*p*, 11*o*, 11*n* and 11*m*, then passed through back side aperture 11*l* at the tip end of the little finger stall, drawn from aperture 10*i* on the opposite, front portion side, sequentially passed through front side lower apertures 10*j*, 10*k*, 10*l* and 10*m* at the tip ends of the finger stalls, then passed through front side aperture 10*n* at the tip end of the first finger stall, then passed through the padding 6 of first finger stall 5*b* and drawn from back side aperture 11*f* at the tip end of the first finger stall. The end of the lacing drawn from aperture 11*r* and the end drawn from back side aperture 11*c* at the tip end of the first finger stall, through which the lacing has been passed first, are interconnected.

When fingertip lacing 1 is not passed through padding 6, as shown in FIGS. 5 to 7 and 9, fingertip lacing 1 is passed through back side aperture 11*c* at the tip end of the first finger stall, drawn from back side aperture 11*d* at the tip end of the finger stall, then sequentially passed through back side apertures 11*e*, 11*f*, 11*g* and 11*h* at middle finger stall 5*c* and third finger stall 5*d*, passed through back side aperture 11*i* at the tip end of the little finger stall and drawn from aperture 10*h* on the opposite, front portion side. Then fingertip lacing 1 is sequentially passed through front side apertures 10*g*, 10*f*, 10*e* and 10*d* at third finger stall 5*d* and middle finger stall 5*c*, then passed through front side aperture 10*c* at the first finger stall, and drawn from front side aperture 10*n* under front side aperture 10*c*.

In the opposite direction in which the lacing is passed through front side upper apertures 10*h*, 10*g*, 10*f*, 10*e* and 10*d* at the tip ends of the finger stalls, fingertip lacing 1 is sequentially passed through front side lower apertures 10*m*, 10*l*, 10*k* and 10*j*, then passed through front side aperture 10*i* at the tip end of the little finger stall, drawn from aperture 11*l* on the opposite, back portion side, then sequentially passed through back side lower apertures 11*m*, 11*m*, 11*o*, 11*p* and 11*q* at the finger stalls, and drawn from back side aperture 11*r* at the tip end of the first finger stall. The end of the lacing drawn from aperture 11*r* and the end drawn from back side aperture 11*c* at the tip end of the first finger stall through which the lacing has been passed first are interconnected.

When a single fingertip lacing 1 is tied on the back portion side at the tip end of the little finger, the single fingertip lacing 1 is passed in the opposite order to the order of the case in which the single fingertip lacing 1 is tied on the back portion side at the tip end of the first finger stall.

As described above, when fingertip lacing 1 is formed by a single lacing, the spacings between the part from first finger stall 5*b* to little finger stall 5*e* can be widened simply by sequentially pulling apart the tip portions of the finger stalls of the glove. Meanwhile, the spacings between the part from first finger stall 5*b* to little finger stall 5*e* can be narrowed by sequentially getting together the tip ends from first finger stall 5*b* or little finger stall 5*e* where both ends of fingertip lacing 1 are not drawn, and eventually by pulling apart both ends of fingertip lacing 1 while tightening loosened fingertip lacing 1. Therefore, it may take a little more trouble than the case of using two fingertip lacings, i.e., front side fingertip lacing 1A and back side fingertip lacing 1B, but the spacings between the finger stalls can be more easily adjusted than the conventional fingertip lacing. Note that the knot of lacings 1A and 1B may be located either on the side of first finger stall 5*b* or little finger stall 5*e*.

As described above, the fingertip lacing is passed through both front and back portions because sufficient strength or durability cannot be secured by inserting the lacing only through one part and the tip part of the finger stalls is stable in catching a ball in this manner.

In the glove according to the present invention, a lacing can be more easily and quickly passed through the tips of the first finger stall to the little finger stall, which improves work efficiency in the operation of inserting lacings in the manufacture of gloves.

Since the spacings between the finger stalls from the first finger stall to the little finger stall can be adjusted in a wider range, the glove can be adapted for use in a wider range of positions or individual preference. The force from the fingers can be smoothly transmitted.

Since the front portion and back portion are laced with two lines of lacing, i.e., upper and lower lines, higher durability is secured and stable catch can be achieved.

By changing the manner of lacing the front and back portions of the glove with the fingertip lacings, the glove can be more rounded, or the spreading among the finger stalls can be subtly adjusted.

A single long fingertip lacing which laces the tip end part of the glove among the tip end of the thumb stall, the edge of the web and the first finger stall to the little finger stall is divided into a web lacing and a fingertip lacing to lace the part from the first finger stall to the little finger stall, and therefore if a lacing is cut, only the cut lacing is replaced, which improves the work efficiency. Furthermore, a glove of new design may be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baseball or softball glove including a front portion and a back portion stitched together, comprising:

a thumb stall;

a first finger stall;

a middle finger stall;

a third finger stall;

a little finger stall;

a web between said thumb stall and said first finger stall;

a web lacing to tie said web to said thumb stall and said first finger stall; and a fingertip lacing to lace the part from said first finger stall to said little finger stall, wherein said fingertip lacing includes a first line portion passed through said front portion and extending from said first finger stall to said little finger stall, a second line portion passed through said front portion and extending substantially parallel to said first line portion, a third line portion passed through said back portion and extending from said first finger stall to said little finger stall, and a fourth line portion passed through said back portion and extending substantially parallel to said third line portion.

2. The baseball or softball glove according to claim 1, wherein said first, second, third and fourth line portions are formed by a single lacing.

3. The baseball or softball glove according to claim 1, wherein said first and second line portions are formed by a first lacing and said third and fourth line portions are formed by a second lacing.

4. The baseball or softball glove according to claim 3, a knot of both ends of said first lacing is located on the back portion side at said first finger stall, and a knot of both ends of said second lacing is located on the back portion side at said little finger stall.

5. The baseball or softball glove according to claim 3, a knot of both ends of said first lacing is located on the back portion side at said little finger stall, and a knot of both ends of said second lacing is located on the back portion side at said first finger stall.

6. The baseball or softball glove according to claim 1, wherein said glove has a padding inside, and at least one of said first to fourth line portions is passed through said padding.

7. The baseball or softball glove according to claim 1, wherein a pair of front side apertures are provided on said front portion side from said first finger stall to said little finger stall in the direction in which the finger stalls extend, a pair of back side apertures are provided on said back portion side from said first finger stall to said little finger stall in the direction in which the finger stalls extend, and said first and second line portions are passed through said front side apertures, and said third and fourth line portions are passed through said back side apertures.

* * * * *